United States Patent [19]

Linder

[11] 4,255,100

[45] Mar. 10, 1981

[54] ROTARY COMPRESSOR WITH VALVE IN ROTOR

[75] Inventor: Ernst Linder, Mühlacker, Fed. Rep. of Germany

[73] Assignee: Robert Bosch GmbH, Stuttgart, Fed. Rep. of Germany

[21] Appl. No.: 932,025

[22] Filed: Aug. 8, 1978

[30] Foreign Application Priority Data

Sep. 7, 1977 [DE] Fed. Rep. of Germany ..... 2740201

[51] Int. Cl.[3] ..... F04C 18/00; F04C 29/08; F04B 35/04

[52] U.S. Cl. ..... 418/184; 418/185; 418/188; 418/224; 418/270; 417/366; 417/410

[58] Field of Search ..... 418/1, 97, 100, 183, 418/184, 185, 188, 224, 270; 417/356, 366, 410

[56] References Cited

U.S. PATENT DOCUMENTS

| | | | |
|---|---|---|---|
| 397,516 | 2/1889 | Powers | 418/184 |
| 2,274,836 | 3/1942 | Koster | 418/184 |
| 2,468,373 | 4/1949 | Makaroff | 418/100 |
| 2,703,370 | 3/1955 | Steensen | 417/410 |
| 3,176,914 | 4/1965 | Rinehart | 417/410 |
| 3,184,157 | 5/1965 | Galin | 418/185 |
| 3,424,094 | 1/1969 | Clark et al. | 418/185 |
| 4,099,896 | 7/1978 | Glanvall | 418/184 |

FOREIGN PATENT DOCUMENTS

| | | | |
|---|---|---|---|
| 938405 | 1/1956 | Fed. Rep. of Germany | 418/184 |
| 1242100 | 6/1967 | Fed. Rep. of Germany | 418/184 |

*Primary Examiner*—John J. Vrablik
*Attorney, Agent, or Firm*—Michael J. Striker

[57] ABSTRACT

A rotary compressor includes housing means in which an impeller is rotatably mounted. The impeller carries a pair of abutting vanes engaging with outer ends the inner surface of the housing means extending along an endless cam curve to form, between this inner surface and the outer surface of the impeller and portions of the vanes projecting beyond the impeller, working spaces increasing and decreasing during rotation of the impeller so as to compress a gaseous medium passing through radially inward extending inlet passages into the working spaces, to pass from there through valves in the vanes into a central pressure space from where the compressed medium is discharged through an outlet passage communicating with the pressure space; and a method for operating the compressor in which oil for lubrication and sealing is fed together with the gaseous medium into the low pressure side of the compressor to be separated from the gaseous medium by centrifugal action and passed back over gaps between the elements of the compressor to the low-pressure side, whereby a separate oil circuit is created and the pressure medium is passed free of oil to a consumer.

13 Claims, 7 Drawing Figures

ROTARY COMPRESSOR WITH VALVE IN ROTOR

BACKGROUND OF THE INVENTION

The present invention relates to a rotary compressor in which transporting elements slide with the free ends thereof along an endless cam curve to draw in and compress a fluid medium, especially a gaseous fluid medium, during rotation of the impeller. In rotary compressors of the aforementioned kind there is only a single working space provided which has the disadvantage that the compression- and mass-forces are not balanced. Furthermore, due to the direct communication of inlet and outlet passages with the single working space, as for instance shown in the U.S. Pat. No. 1,192,978, oil is always contained in the compressed fluid medium, which is undesirable.

SUMMARY OF THE INVENTION

It is an object of the present invention to provide a rotary compressor which avoids the disadvantages of such rotary compressors known in the art.

It is a further object of the present invention to provide a rotary compressor in which the compression- and mass-forces created during the operation of the compressor are substantially balanced and in which oil, fed with the fluid medium to be compressed into the compressor, is in the interior of the latter separated from the compressed fluid medium so as not to be transmitted with the latter to a consumer.

With these and other objects in view, which will become apparent as the description proceeds, the rotary compressor according to the present invention mainly comprises stationary means forming an inner space defined by an inner peripheral surface extending along an endless cam curve, inlet passage means for a fluid medium communicating with said inner space and leading from the outside in radially inward direction into said inner space and having inner open ends at said cam curve, impeller means rotatably mounted in said stationary means and defining a central pressure space, means carried by said impeller means for rotation therewith and having outer free ends engaging said cam curve for sucking the fluid medium into the inner space and for compressing the medium, valve means carried by one of said rotatable means for passing the compressed medium in radially inward direction into said pressure space, and outlet passage means communicating with the pressure space.

The aforementioned impeller means is preferably constituted by an annular member and provided with diametraically opposite slots and the means carried by the impeller means are constituted by a pair of vanes slidably arranged in the slots and abutting with side faces thereof against each other. The aforementioned valve means are preferably carried by the vanes in the region of the outer ends of the latter.

The fluid medium to be compressed is preferably a gaseous medium, especially freezing vapor.

The present invention relates also to a method of operating the rotary compressor in which oil is fed together with the gaseous medium into the low pressure space of the compressor and passed with the latter into the central high pressure space in which the oil is separated by centrifugal action from the gaseous medium and guided separated from the gaseous medium through any clearance in the slots between the impeller and the vanes back to the low pressure space so that the compressed gaseous medium leaving the compressor through the outlet passage will be free of any oil.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
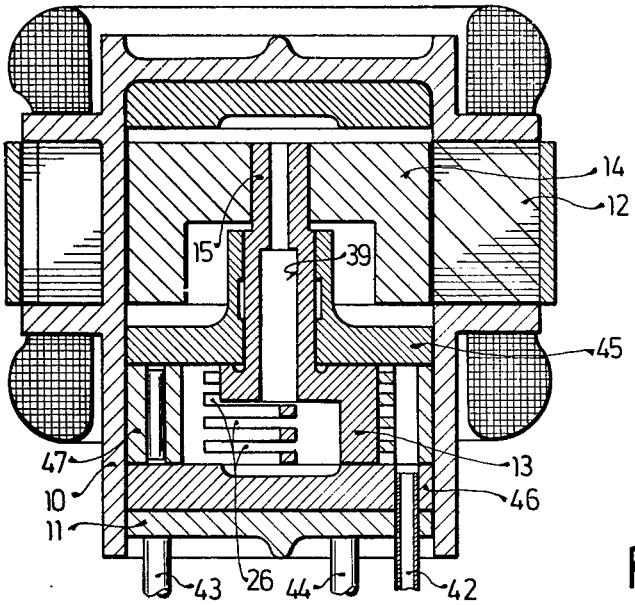
FIG. 1 is a cross-section through the compressor taken along the line I—I of FIG. 2.
Figure 6:
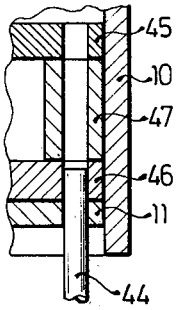
FIG. 6 is a cross-section taken along the line VI—VI of FIG. 2.
Figure 2:
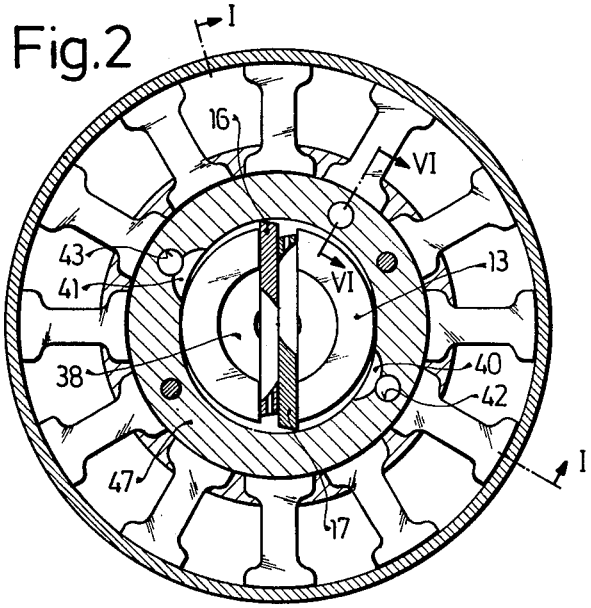
FIG. 2 is a transverse cross-section through the compressor shown in FIG. 1.

Referring now to the drawing and more specifically to FIGS. 1 and 2 of the same, it will be seen that the compressor according to the present invention comprises a substantially pot-shaped housing 10 which is closed at one end by a cover 11. The stator winding 12 of an electromotor driving the impeller 13 of the compressor is arranged outside the housing 10 so that the cooling of the stator winding is performed by the air surrounding the compressor. The rotor 14 of the electromotor drives over a rotor extension 15 the impeller 13. The part of the impeller 13 which carries the vanes 16 and 17 is ring-shaped and provided with a radial slot 18 extending therethrough in which the two vanes 16 and 17 of equal length are slidably arranged, abutting with inner faces thereof against each other. The slot 18 passes through the center of the impeller 13. The outer ends of the vanes 16 and 17 slide along an endless cam curve 19 which is oval shaped. The center of the impeller 13 is located at the center of the cam curve 19 so as to form two working spaces 20, 21 (suction and pressure spaces) between the outer surface of the impeller 13 and the cam curve 19.

Figure 5:
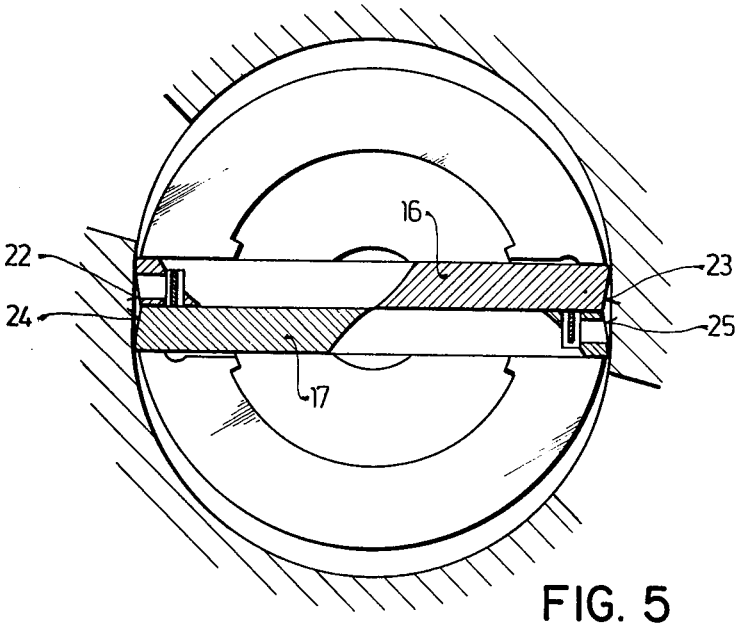

As shown in FIG. 5, the length of each of the vanes 16 and 17 is exactly equal to the smallest diameter of the cam curve 19. Each of the vanes is chamfered at the outer ends thereof and the chamfers 22 and 23 on the vane 16 extend in the same direction opposite to the chamfers 24 and 25 on the vane 17. Each of the vanes 16 and 17 has one, or a plurality of openings 26, respectively 27, having each one end adjacent the outer end of the respective vane and extending from the outer end inwardly to such a distance that in the position as shown in FIG. 5 the openings end at the faces of the vanes which are in contact with each other at the same point.

The remaining portion 30, respectively 31, of each vane located between the opening 26, respectively 27, and one of the outer vane edges is formed with a plurality of radial bores 32, respectively 33, passing therethrough, each of which communicates with a small space 34, respectively 35, in which a plate-shaped valve body 36, respectively 37, is arranged. The valve bodies 36 and 37 control the connection from the working spaces 20, 21 over the openings 26 and 27 to a central pressure space 38 located within the impeller 13, which communicates with the space in which the rotor 14 of the electromotor driving the impeller 13 is located through a bore 39 extending through the extension 15 of the rotor.

An inlet passage 40 communicates with the working space 20 and a corresponding inlet passage 41 communicates with the working space 21. These inlet passages 40 and 41 in turn communicate through conduits and channels 42 and 43 with a source of the medium to be compressed, for instance freon vapor. The compressed medium passes out from the central pressure space 38, respectively from the interior of the housing 10 through a conduit and channel 44. The channel 44 passes also in part through two plates 45 and 46 which are fixedly connected to the housing 10 to opposite sides of the impeller 13. The plate 45 forms at the same time a bearing for the impeller 13 and the rotor 14 of the electromotor. The outlet channel 44 passes also through a ring 47 arranged between the plates 45 and 46 and the inner surface of the ring 47 forms the aforementioned endless cam curve 19. The channels 42 and 43 pass also through the ring 47.

Figure 3:
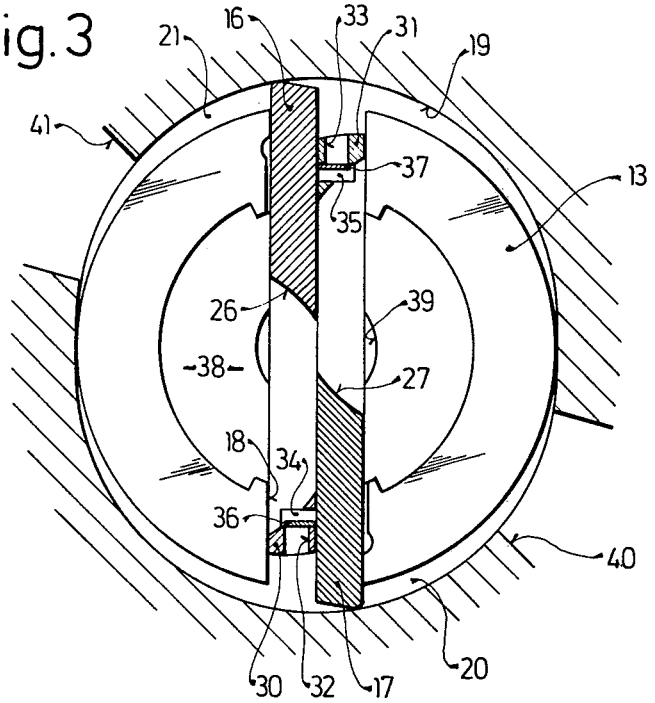
FIGS. 3–5 illustrate various positions of the impeller and the blades slidably mounted thereon.
Figure 4:
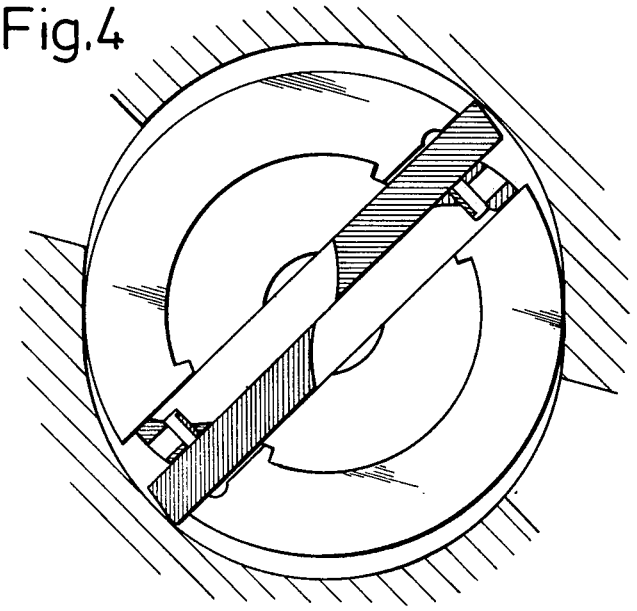

Assuming the impeller 13 is rotated by the rotor 14 of the electromotor in clockwise direction, then the gaseous medium to be compressed is sucked, when the impeller 13 is in the position shown in FIG. 5 through the inlet passages 40 and 41 into the working respectively suction spaces 20 and 21. The vanes 16 and 17 are thereby located substantially in a plane which passes through the smallest diameter of the cam curve 19. During further rotation of the impeller 13 to the position shown in FIG. 3 the sucked in medium is compressed. The valve bodies 36 and 37 still close the bores 32 and 33 at the inner ends thereof since the pressure in the central pressure space 38 is still greater than that in the working spaces. During further rotation of the impeller 13 to the position as shown in FIG. 4, the pressure in the working spaces becomes greater than that in the central pressure space 38 so that the valve bodies 36 and 37 are lifted from the valve seats so that the compressed pressure medium passes through the openings 26 and 27 in the vanes 16 and 17 into the central pressure space 38 and over the bore 39 into the interior of the housing from where it passes through the conduit 44 to a consumer. The valve bodies 36 and 37 are arranged freely movable in the spaces 34 and 35 and are pressed against the seats by centrifugal force.

Essentially is also that during the operation of the compressor lubricating oil is added in the working spaces 20, 21 to the pressure medium, in any suitable manner not shown in the drawing, from where the oil passes with the pressure medium into the central pressure space 38. In the central pressure space 38 the oil is flung outwardly by centrifugal action and thus separated from the compressed medium. The oil passes through any clearance between the faces of the impeller 13 forming the slot 18 therethrough and the adjacent faces of the vanes 16 and 17 to the low pressure side of the compressor where it is cooled by the introduced pressure medium, partly absorbed by the latter and partly precipitated on the inner face 19 of the ring 47. There the oil is scraped off by the ends of the vanes 16 and 17 and can therefore not leave the compressor so that an oil film will always remain on the inner surface 19 of the ring. At the contact between the outer ends of the vanes and the surface 19 only a sealing against passage of the oil and not of the pressure medium is necessary and a proper lubrication at this contact is also assured.

The direct introduction of the pressure medium through the two inlet passages 40 and 41 into the working spaces 20 and 21 will assure that the pressure medium passes at relatively low temperature into the compressor to thereby cool the oil and the surface 19 to thus conduct the friction heat away from the location where it is produced. By the specific construction of the impeller and the vanes guided therein mass- and compression-forces are completely balanced.

Figure 7:
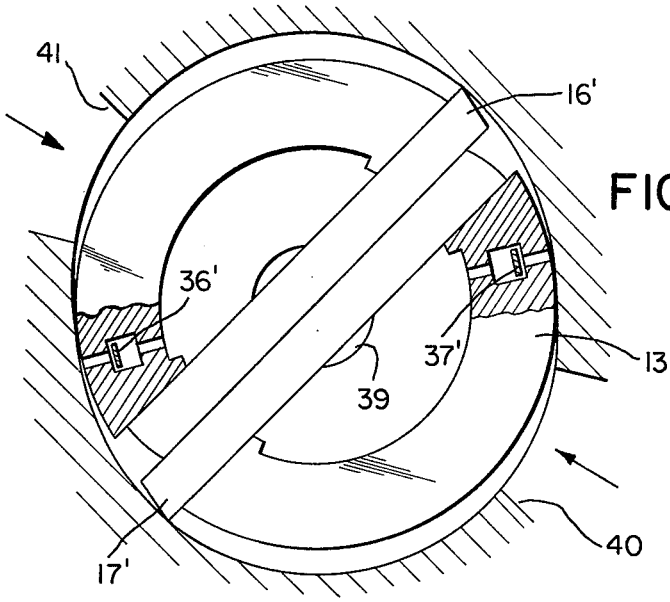
FIG. 7 illustrated a modification of the valve arrangement shown in FIG. 3.

The arrangement of the two abutting vanes 16 and 17 passing through the slot 18 in the impeller 13 and the arrangement of the valves in the vanes has the advantage that the centers of gravity of the vanes are arranged adjacent the middle thereof so that small mass forces are created. Furthermore the forces exerted by the pressure medium onto the vanes are better balanced and the guiding length of the vanes is increased. The vanes are preferably formed from aluminum alloy. It is also possible, as shown in FIG. 7, to arrange the valves 36' and 37' in the impeller 13, for instance adjacent to the vanes, essential is only that the valves are located in rotating parts of the compressor so that they may be controlled by centrifugal force.

The arrangement of the stator winding 12 at the outside of the housing 10 has, as already mentioned, the advantage that it can be cooled by air. Thereby an overheating of the pressure medium is avoided which, assuming the pressure medium is freon, leads to an increased efficiency because the refrigeration plant need not additionally produce a cooling effect for cooling the compressor. In addition the stator winding 12 need not to be formed from material resistant against any corrosive action of freon.

It is to be understood that the above-described compressor can also be used for transporting of a liquid pressure medium and it has the advantage of an especially compact construction.

It will be understood that each of the elements described above, or two or more together, may also find a useful application in other types of rotating compressors differing from the types described above.

While the invention has been illustrated and described as embodied in a rotating compressor having an impeller formed with a transverse slot in which a pair of abutting vanes are slidably arranged the outer ends of which engage an endless cam surface, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rotary compressor comprising stationary means forming an inner space defined by an inner peripheral surface extending along an endless cam curve of oval configuration; inlet passage means for a fluid medium communicating with said inner space and having inner open ends at said peripheral surface; annular impeller means rotatably mounted in said stationary means and defining a central pressure space, said impeller means being provided with diametrically opposite slots; means carried by said impeller means for rotation therewith and having outer free ends engaging said cam curve for sucking the gaseous medium into said space and for compressing the medium, said means carried by said impeller means being constituted by a pair of vanes slidably arranged in said slots and abutting with side faces thereof against each other, said vanes extending through said central pressure space and having throughout their length the same thickness and height; only two valve means carried by one of said rotatable means for passing the compressed medium in radial inner direction into said pressure space; and outlet passage means communicating with said pressure space.

2. A rotary compressor as defined in claim 1, wherein the outer end faces of said vanes are chamfered so as to engage said inner peripheral surface substantially with a line contact.

3. A rotary compressor as defined in claim 1, wherein said thickness of each of said vanes is substantially equal to half of the width of the slot.

4. A rotary compressor as defined in claim 1, wherein said annular impeller means has an outer diameter substantially equal to the smallest diameter of said oval shaped inner peripheral surface so as to engage said inner peripheral surface along two diametrically opposite lines and wherein said inlet passage means comprises two inlet passages having diametrically opposite open ends at said inner surface adjacent and downstream, as considered in the direction of rotation of said impeller means, of said contact lines.

5. A rotary compressor as defined in claim 1, wherein said valve means are carried by said vanes.

6. A rotary compressor as defined in claim 5, wherein said impeller means is arranged within said cam curve in such a manner to define with said vanes diametrically opposite suction-respective compression spaces.

7. A rotary compressor as defined in claim 6, wherein the length of each vane corresponds substantially to the smallest diameter of said oval cam curve.

8. A rotary compressor as defined in claim 1, wherein each of said vanes is formed with at least one opening therethrough extending over part of the length of the respective vane and having an outer end, each of said vane being formed in a portion radially outward of said outer end of said opening with at least one radial bore and a small cavity at the inner end of the radial bore communicating with the respective opening, said valve means being located in said small cavity and controlling passage of fluid through said bore.

9. A rotary compressor as defined in claim 8, wherein said opening in each vane extends at least to the middle thereof.

10. A rotary compressor as defined in claim 8, wherein said valve means is a flutter valve having a plate-shaped valve body.

11. A rotary compressor as defined in claim 1, and including a pair of plates closing said inner space at opposite ends, said impeller means being provided with a coaxial extension formed with a bore therethrough and one of said plates forming a bearing in which said extension is turnably mounted.

12. A rotary compressor as defined in claim 11, and including a housing having a cylindrical wall and being closed at one end, said stationary means being constituted by a ring having an outer surface in engagement with the inner surface of said peripheral wall, said one plate being spaced from said closed end of said housing and including electric motor means for driving said impeller, said motor means including a rotor fixed to a portion of said extension projecting beyond said bearing and a stator winding at the outside of said housing.

13. A rotary compressor as defined in claim 12, wherein said outlet passage means communicates with the space between said closed end of said housing and said one plate.

* * * * *